US011716563B2

(12) United States Patent
Zastoupil et al.

(10) Patent No.: US 11,716,563 B2
(45) Date of Patent: Aug. 1, 2023

(54) PORTABLE LOUDSPEAKER SYSTEMS

(71) Applicant: Bose Corporation, Framingham, MA (US)

(72) Inventors: Greg J. Zastoupil, North Grafton, MA (US); Peter P. Premo, Charlton, MA (US); Peter C. Santoro, Groton, MA (US); Craig Small, Framingham, MA (US); Joseph J. Kutil, Franklin, MA (US); David Edwards Blore, Westborough, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 17/347,103

(22) Filed: Jun. 14, 2021

(65) Prior Publication Data

US 2021/0392431 A1 Dec. 16, 2021

Related U.S. Application Data

(60) Provisional application No. 63/039,183, filed on Jun. 15, 2020.

(51) Int. Cl.

| | |
|---|---|
| ***H04R 1/28*** | (2006.01) |
| ***H04R 1/02*** | (2006.01) |
| ***H04R 1/26*** | (2006.01) |

(52) U.S. Cl.

CPC ..... *H04R 1/2834* (2013.01); *H04R 1/026* (2013.01); *H04R 1/26* (2013.01); *H04R 1/2819* (2013.01)

(58) Field of Classification Search

CPC .... H04R 1/02; H04R 1/025; H04R 2201/028; H04R 7/14; H04R 9/022

See application file for complete search history.

(56) References Cited

U.S. PATENT DOCUMENTS

D685,392 S 7/2013 Chamness et al.
2004/0003960 A1* 1/2004 Usuki ..... H04R 9/06 181/173

(Continued)

FOREIGN PATENT DOCUMENTS

CA 2387939 A1 5/2001
DE 20 2009 011146 U1 11/2009

OTHER PUBLICATIONS

International Search Report and Written Opinion dated Oct. 6, 2021 for PCT/US2021/037345.

(Continued)

*Primary Examiner* — Kile O Blair
(74) *Attorney, Agent, or Firm* — Bose Corporation

(57) ABSTRACT

A loudspeaker system includes a subwoofer. The subwoofer includes a housing having a plurality of walls which together define an acoustic cavity. The plurality of walls includes a front wall, a rear wall, a top wall, a bottom wall, and a plurality of sidewalls extending between the top and bottom walls and between the front and rear walls. A first transducer mounted to the front wall of the housing. The first transducer includes a diaphragm having a major axis and a minor axis. The major axis has a fist end proximate the bottom wall and an opposite, second end proximate the top wall, such that the major axis is arranged vertical, relative to ground when the subwoofer is rested on its bottom wall. The top wall has a handle such that the loudspeaker can be carried with the major axis arranged vertical to ground.

20 Claims, 14 Drawing Sheets

(56) References Cited

U.S. PATENT DOCUMENTS

| | | | | |
|---|---|---|---|---|
| 2005/0008188 | A1* | 1/2005 | Harris | H04R 9/043 381/404 |
| 2006/0222190 | A1 | 10/2006 | Jacobs et al. | |
| 2008/0080727 | A1 | 4/2008 | Prenta et al. | |
| 2008/0085022 | A1 | 4/2008 | Polster | |
| 2010/0111342 | A1* | 5/2010 | Jacob | H04R 1/26 381/332 |
| 2015/0201255 | A1 | 7/2015 | Porter | |

OTHER PUBLICATIONS

"Bose L1 Pro16 Portable Line Array System review" by Paul Riario, Guitar World website, Apr. 20, 2021 (available at https://www.guitarworld.com/reviews/bose-l1-pro16-portable-line-array-system-review, last accessed Feb. 15, 2023).

"Bose L1 Pro 8 Review—Slimline PA System With Punch" by Patryk Biemacki, Home DJ Studio website, Nov. 19, 2022. (available at https://homedjstudio.com/bose-l1-pro-8-review/, last accessed Feb. 15, 2023).

"Gear Review: Bose's L1 Pro16 Is a Refined and Affordable Amplification Solution for Acoustic Guitarists" by Doug Young, Acoustic Guitar website, May 14, 2021. (available at https://acousticguitar.com/gear-review-boses-l1-pro16-is-a-refined-and-affordable-amplification-solution-for-acoustic-guitarists/, last accessed Feb. 15, 2023).

* cited by examiner

PORTABLE LOUDSPEAKER SYSTEMS

CROSS-REFERENCE TO RELATED APPLICATIONS

This application is a continuation of U.S. Application Ser. No. 63/039,183, filed Jun. 15, 2020, which is incorporated herein by reference in its entirety.

BACKGROUND

This disclosure relates to portable loudspeaker systems.

SUMMARY

All examples and features mentioned below can be combined in any technically possible way.

In one aspect, a loudspeaker system includes a subwoofer. The subwoofer includes a housing having a plurality of walls which together define an acoustic cavity. The plurality of walls includes a front wall, a rear wall opposite the front wall, a top wall, a bottom wall opposite the top wall, and a plurality of sidewalls that extend between the top wall and the bottom wall and between the front and rear walls. A first electro-acoustic transducer mounted to the front wall of the housing. The first electro-acoustic transducer includes a diaphragm that has a major axis and a minor axis. The major axis being longer than the minor axis. The major axis has a first end that is proximate the bottom wall and an opposite, second end that is proximate the top wall, such that the major axis is arranged substantially vertical, relative to ground when the subwoofer is rested on its bottom wall. The top wall has a handle such that the loudspeaker can be carried with the major axis arranged vertical to ground.

Implementations may include one of the following features, or any combination thereof.

In some implementations, the sidewalls are substantially parallel with the major axis of the first electro-acoustic transducer.

In certain implementations, the loudspeaker system includes an amplifier disposed within the acoustic cavity, and one or more bass reflex ports that extend through one or more of the plurality of walls. The one or more bass reflex ports may be arranged to facilitate a cooling air flow across the amplifier.

In some cases, the rear wall comprises an i/o panel and the subwoofer includes an amplifier disposed within the acoustic cavity. The amplifier may be mounted to the i/o panel such that heat dissipated from the amplifier can be transferred through the i/o panel via conduction.

In certain cases, the amplifier has a power output of 400 Watts to 1000 Watts

In some examples, the subwoofer includes a mixing console disposed within the acoustic cavity and mounted to the i/o panel.

In certain examples, the major axis is about 1.30 times to about 1.50 times longer than the minor axis, e.g., the major axis may be 1.38 times to 1.42 times longer than the minor axis.

In some implementations, the subwoofer provides a Sound Pressure Level (SPL) output of about 110 dB to about 130 dB SPL with 1000 Watts or less.

In certain implementations, the subwoofer has a total package volume of 120 Liters or less, e.g., the subwoofer may have a total package volume of about 80 Liters to about 120 Liters.

In some cases, the acoustic cavity has an acoustic volume of 60 Liters or less, e.g., the acoustic cavity may have an acoustic volume of about 30 Liters to about 60 Liters.

In certain cases, the loudspeaker system may include a line array assembly that includes a plurality of second electro-acoustic transducers. The subwoofer may include a receptacle for receiving the line array assembly. The receptacle may include a first electrical connector and wherein the line array assembly includes a second electrical connector that is configured to mate with the first electrical connector for powering the line array assembly via the subwoofer.

In some examples, the second electro-acoustic transducers are mid/high frequency transducers having an operating frequency range of about 200 Hz to about 18 kHz.

In certain examples, the diaphragm is in the shape of an ellipse, an oval, or a racetrack.

In some implementations, the first electro-acoustic transducer is a low frequency transducer having an operating frequency range of about 20 Hz to about 300 Hz.

In certain implementations, the first electro-acoustic transducer has a suspension compliance of about 0.06 mm/N to about 0.12 mm/N; a maximum linear excursion of about 6.00 mm to about 9.50 mm; an effective cone diameter of about 22.00 cm to about 32.00 cm; an effective piston area of about 410.00 cm^2 to about 762.00 cm^2; and a maximum SPL of about 110 dB to about 130 dB.

In some cases, the diaphragm includes integral ribs for increased stiffness.

In certain cases, the housing has a height-to-width ratio of about 1.7 to about 2.2.

DETAILED DESCRIPTION

This disclosure is based on the realization that it may be desirable to incorporate an oblong transducer into a portable subwoofer to enable a narrower subwoofer design that allows the center of mass of the subwoofer to rest closer to a user's body during transport.

Figure 1A:
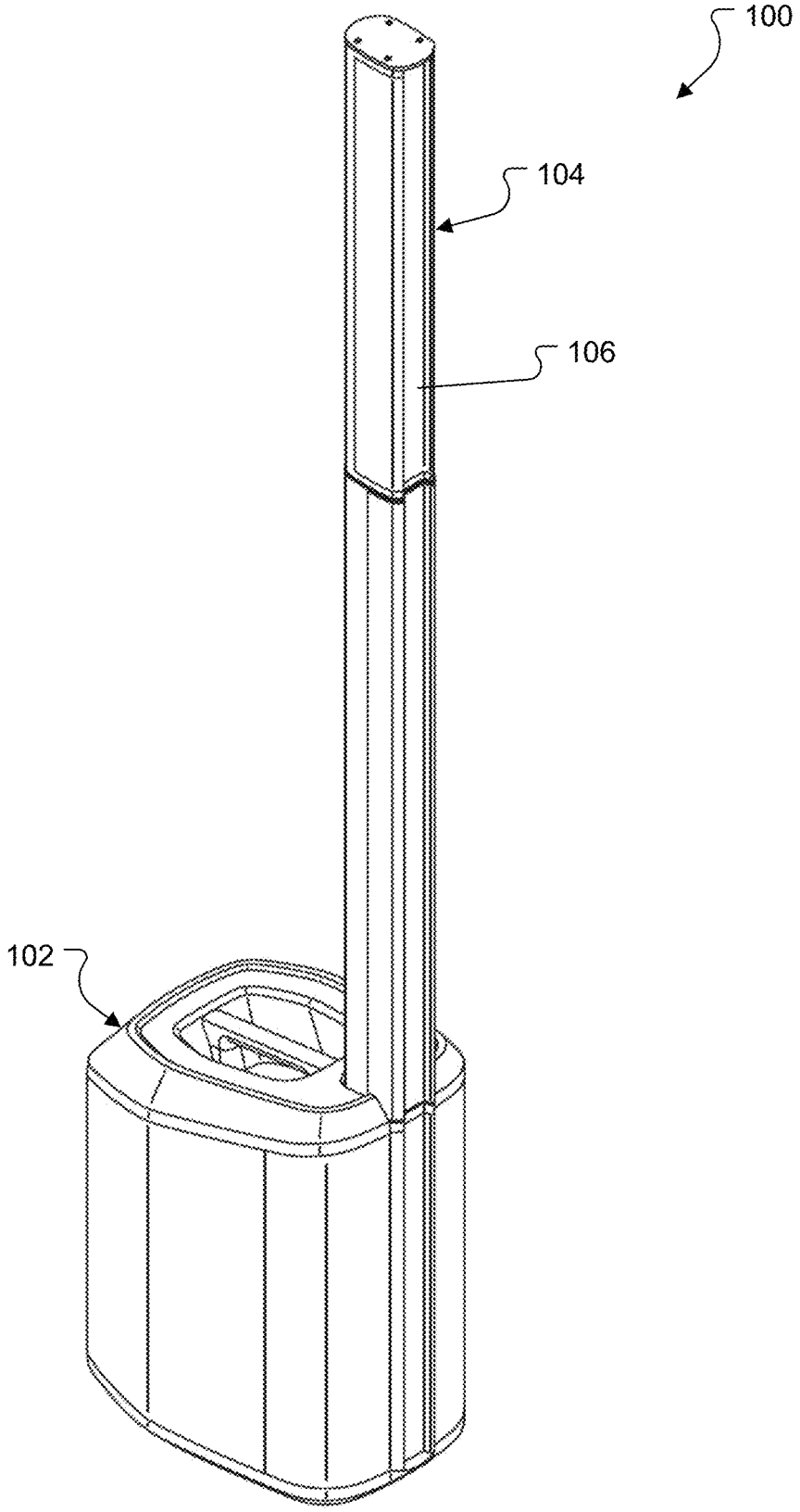
FIG. 1A is a perspective view of a loudspeaker system as shown from the front, top, and left side.
Figure 1B:
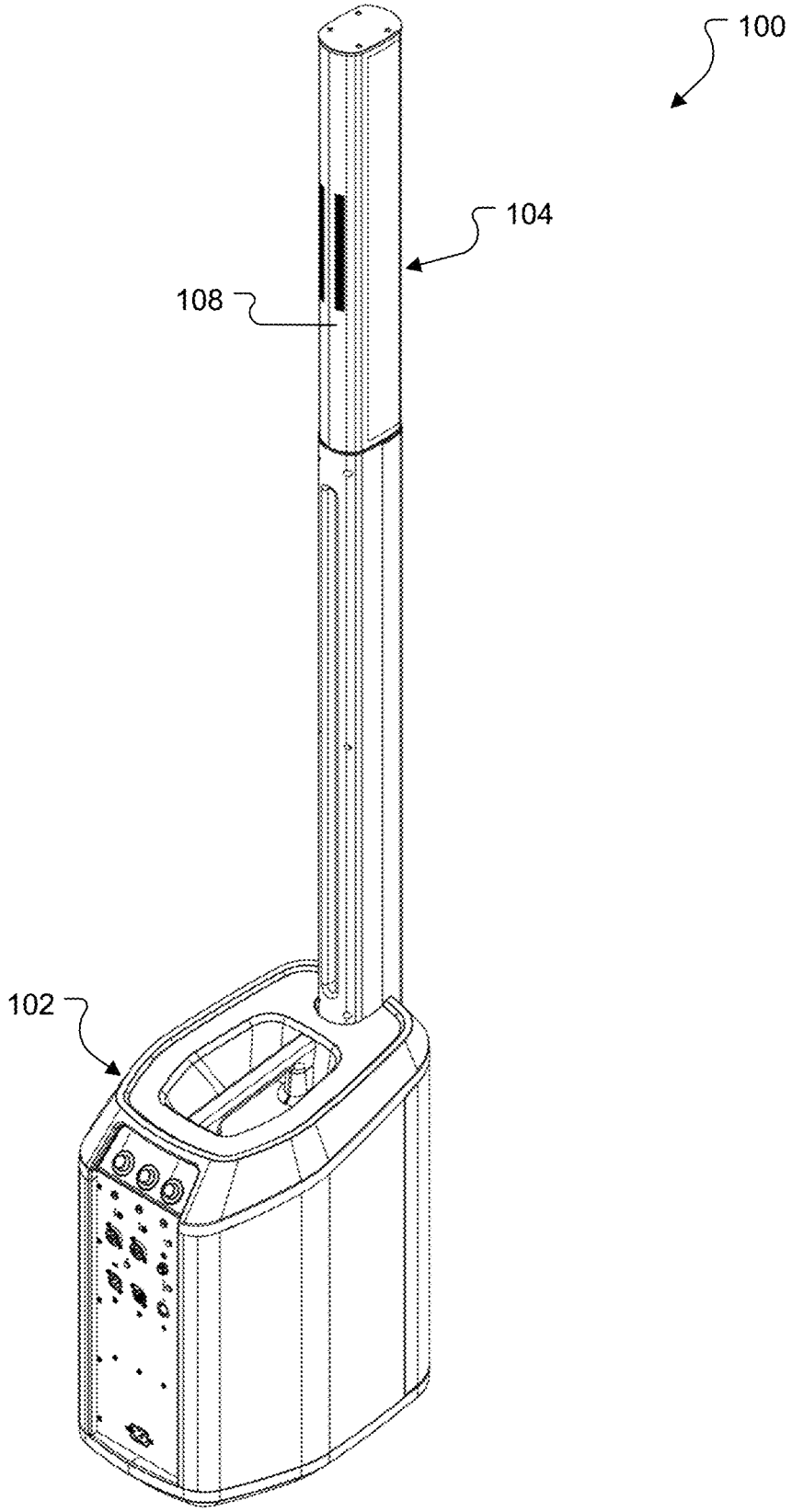
FIG. 1B is a perspective view of the loudspeaker system of FIG. 1A as shown from the rear, top, and left side.
Figure 2A:
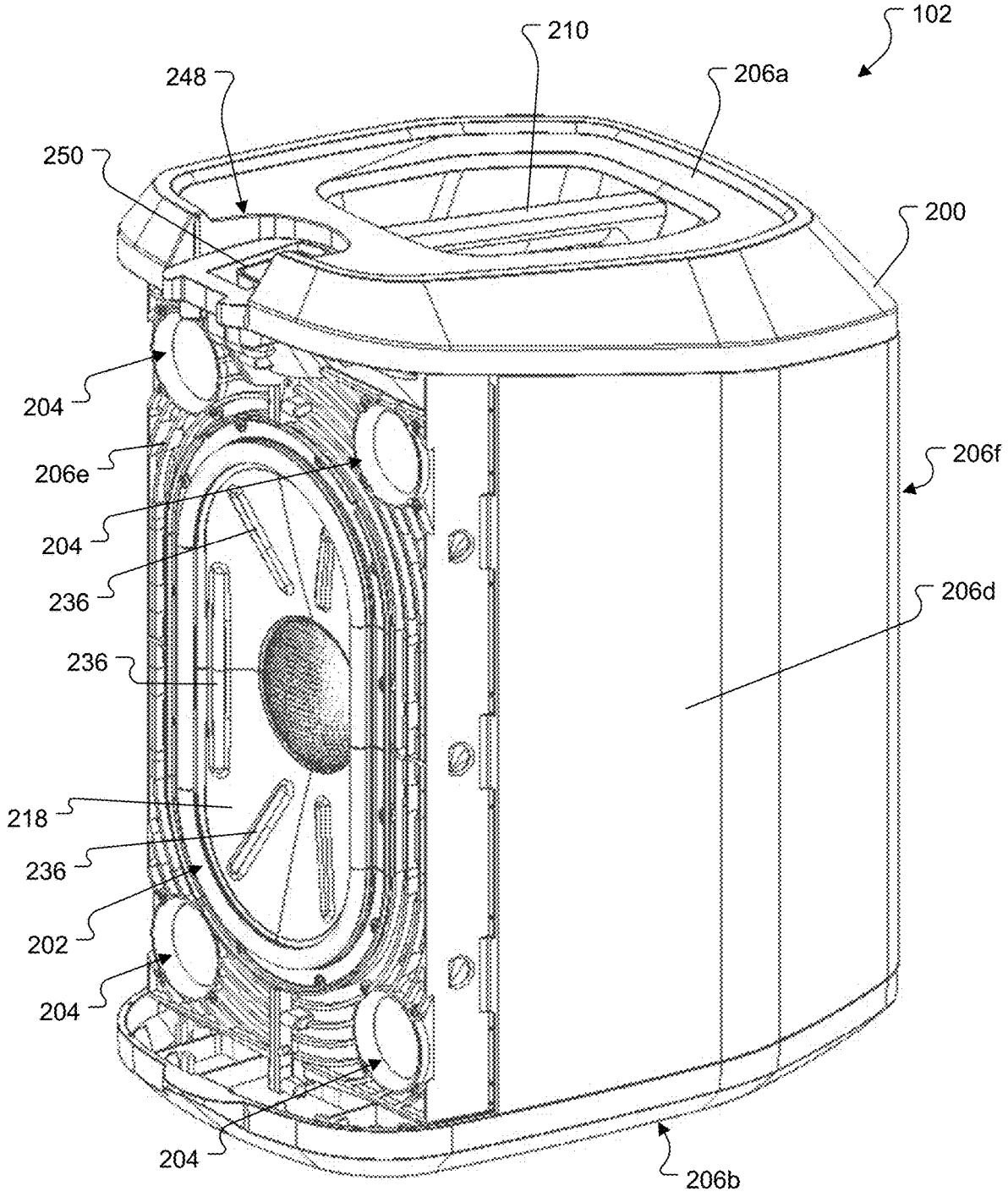
FIG. 2A is a perspective view of a subwoofer from the loudspeaker system of FIG. 1A as shown, without a grille, from the front, top, and right side.
Figure 2B:
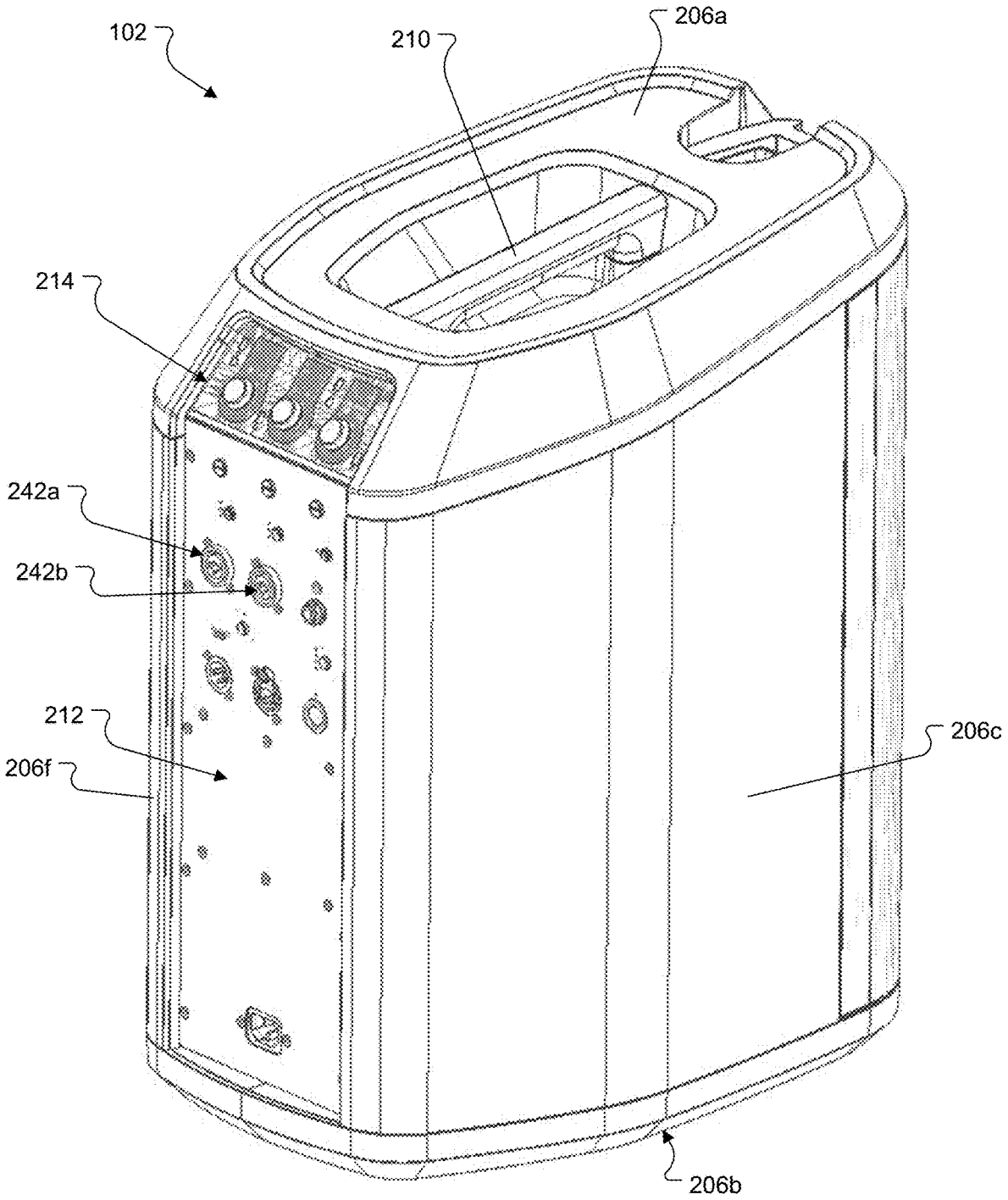
FIG. 2B is a perspective view of the subwoofer of FIG. 2A as shown from the rear, top, and left side.
Figure 2C:
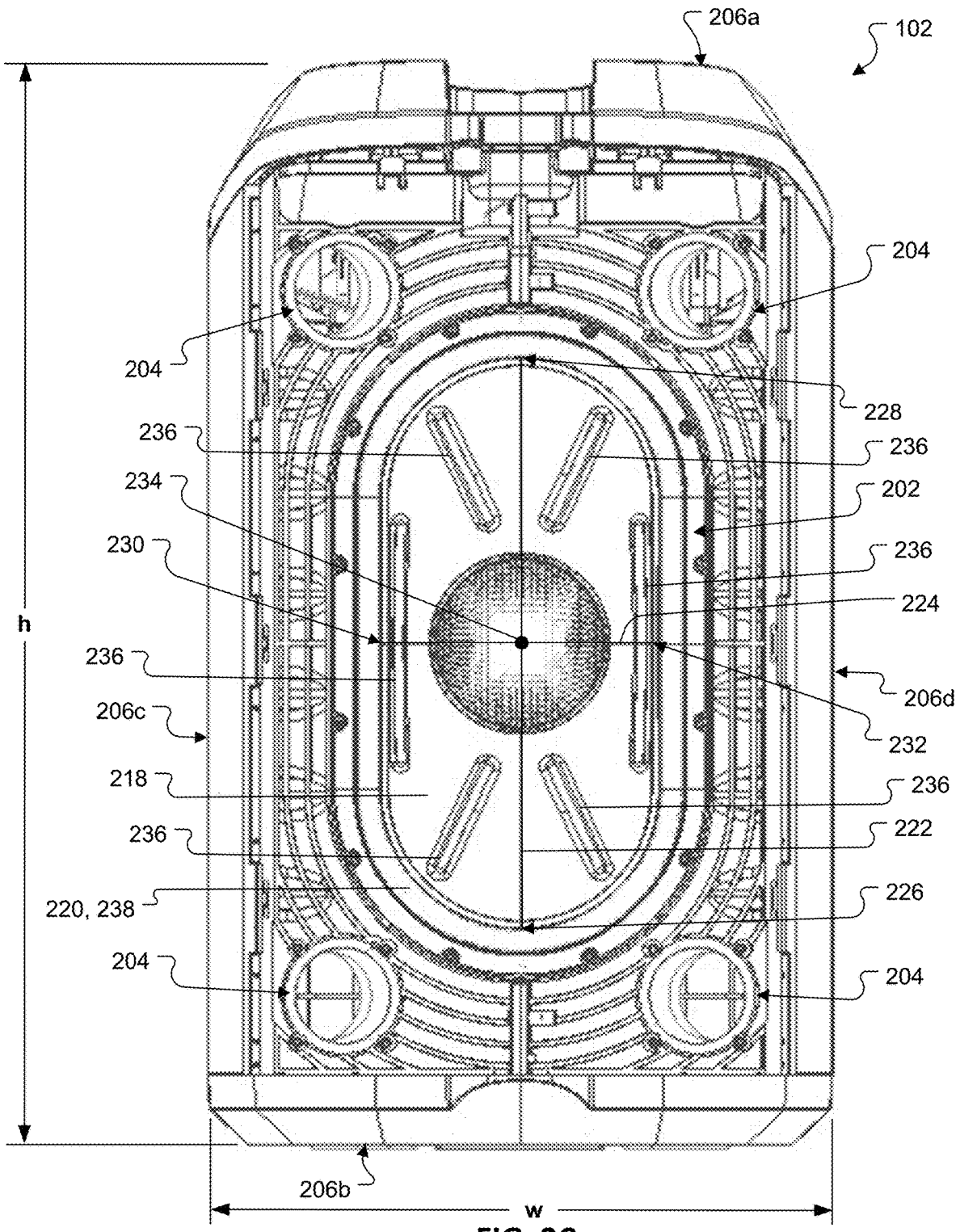
FIG. 2C is a front view of the subwoofer of FIG. 2A, shown without a grille.
Figure 3:
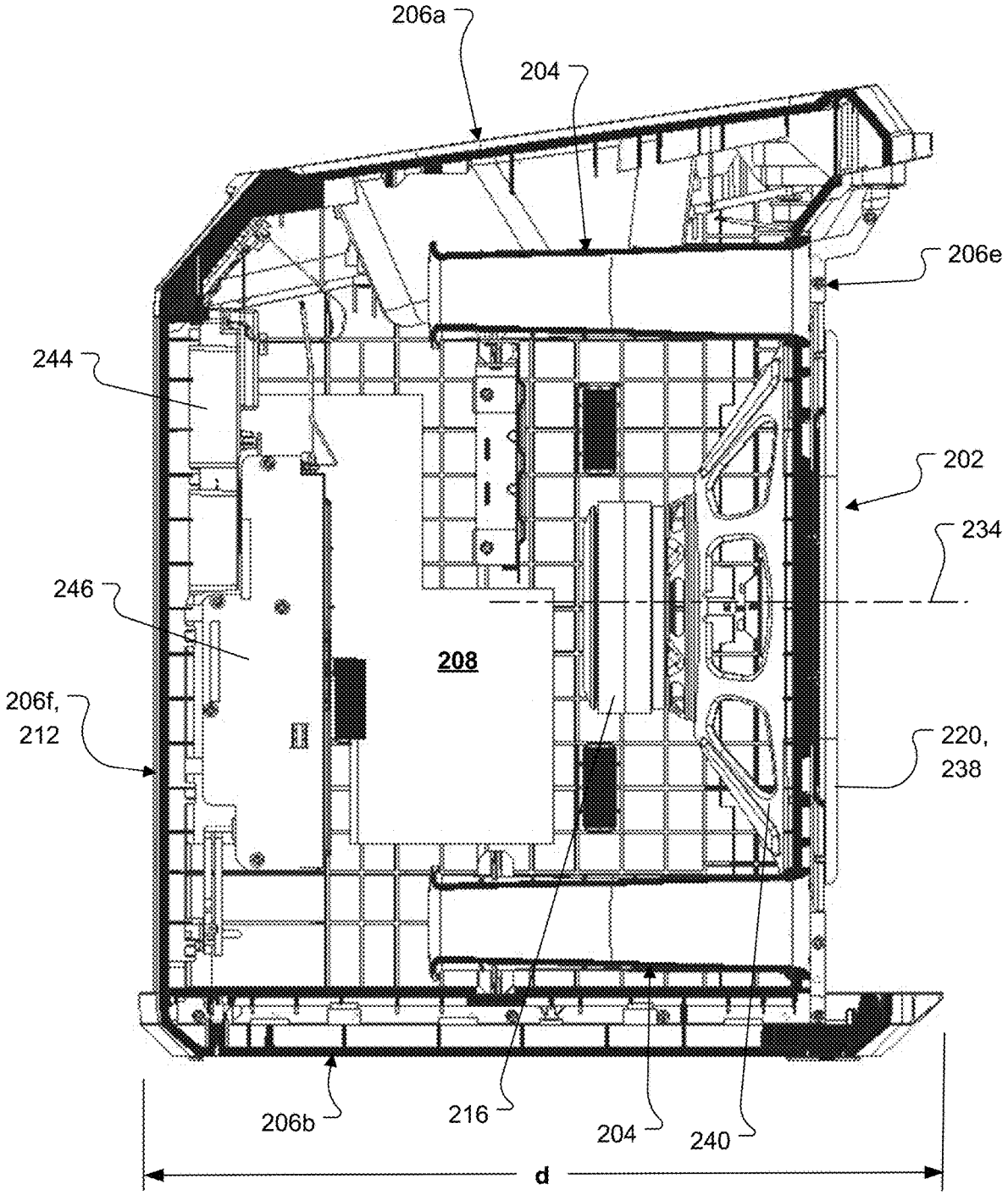
FIG. 3 is a cross-sectional side view of the subwoofer of FIG. 2A.

FIG. 1 illustrates an exemplary loudspeaker system 100. The loudspeaker system 100 includes a subwoofer 102 and a line array assembly 104. With reference to FIGS. 2A-3, the subwoofer 102 includes a housing 200 (a/k/a "subwoofer housing") that supports an electro-acoustic transducer 202 and bass reflex ports 204. The housing 200 includes a plurality of walls (collectively "206"), which define an acoustic cavity 208 (FIG. 3). The plurality of walls 206 include a top wall 206*a*, a bottom wall 206*b*, left and right sidewalls 206*c* and 206*d*, respectively; a front wall 206*e*; and a rear wall 206*f*. The electro-acoustic transducer 202 and the bass reflex ports 204 are supported by the front wall. The top wall 206*a* supports a handle 210 for carrying the subwoofer 102. The rear wall 206*f* includes an input/output (i/o) panel 212 with integral mixer user interface (UI) 214 (FIG. 2B). In some cases, the subwoofer 102 has an operating frequency range of about 20 Hz to about 300 Hz, e.g., about 35 Hz to about 200 Hz, e.g., about 40 Hz to about 200 Hz.

The electro-acoustic transducer 202 can be any known type of electro-acoustic transducer. For example, as shown in FIG. 3, the electro-acoustic transducer 202 can include an electric motor 216, a diaphragm 218 (FIG. 2C), and a suspension 220. Notably, as shown in FIG. 2C, the diaphragm 218 has an oblong shape, e.g., the shape of an ellipse, an oval, or a racetrack (having parallel sides and rounded ends that extend between the parallel sides, a/k/a "stadium"). The diaphragm 218 has a major axis 222 and a minor axis 224. The major axis 222 has a first end 226 proximate the bottom wall 206*b* and an opposite, second end 228 proximate the top wall 206*a*, such that the major axis 222 is arranged substantially vertical, relative to ground, during normal use (i.e., with the subwoofer 102 resting on its bottom wall 206*b*). The minor axis 224 is arranged perpendicular to the major axis 222 and has a first end 230 that is proximate the left sidewall 206*c* and an opposite, second end 232 proximate the right sidewall 206*d*. The electro-acoustic transducer 202 includes a motion axis 234 that is perpendicular to the major and minor axes 222, 224. The motion axis 234 passes through a point of intersection of the major and minor axes 222, 224.

The diaphragm 218 is also arranged such that its major axis 222 (FIG. 2C) is arranged vertically when the subwoofer 102 is transported (i.e., lifted and carried by its handle 210 (FIGS. 2A & 2B) so that the center of mass of the subwoofer 102 rests closer to the user's body (as compared to a design with a circular diaphragm with an equivalent surface area). The benefit(s) is/are this configuration allows for a narrower subwoofer 102 that is easier to carry because its center of mass is able to rest closer to the user's/carrier's body when it is carried by its handle. The oblong diaphragm 218 provide the same output but with tighter front baffle density as compared to a round diaphragm with an equivalent radiating surface area. The oblong diaphragm 218 also provides for more efficient use of front baffle space as compared to an arrangement with multiple small transducers that collectively have the equivalent radiation surface area.

The diaphragm 218 has a width of about 7 inches to about 10 inches and a height of about 13 inches to about 18 inches. The diaphragm has a height-to-width ratio of about 1.38 to about 1.42. In that regard, the major axis is about 1.38 times to about 1.42 times longer than the minor axis. The diaphragm 218 may be formed of paper pulp, preferably paper pulp. As shown in FIGS. 2A & 2C the diaphragm 218 may be formed with ribs 236 for added stiffness.

The suspension 220 includes a surround 238 and a spider (not shown). The surround 238 couples an outer peripheral edge of the diaphragm 218 to a structural member (basket 240 (FIG. 3), e.g., a steel basket) that supports the electric motor 216 (e.g., a Y35 ferrite motor). The surround 238 is formed of a tear resistant compliant material such as polyurethane foam.

The electro-acoustic transducer 202 has a suspension compliance of about 0.06 mm/N to about 0.12 mm/N; a maximum linear excursion of about 6.00 mm to about 9.50 mm, e.g., 6.90 mm to 9.25 mm; an effective cone diameter of about 22.00 cm to about 32.00 cm, e.g., 22.90 cm to 31.13 cm; an effective piston area of about 410.00 cm^2 to about 762.00 cm^2, e.g., 411.87 cm^2 to 761.10 cm^2; and a maximum SPL of about 110 dB to about 130 dB, e.g., 115 dB to 125 dB.

The subwoofer 102 includes electronics for processing audio signals received via connectors 242*a*, 242*b* (FIG. 2B) and for driving the electro-acoustic transducer 202. Referring to FIG. 3, the electronics include a mixing console 244 and an amplifier 246 (a/k/a "audio amplifier") both of which are disposed within the acoustic cavity 208 and are supported on the i/o panel 212 on the rear wall 206*f* of the housing 200. The mixing console 244 receives audio input via the connectors 242*a*, 242*b* and user input via the mixer UI 214 (FIG. 2B).

The amplifier 246 has a power output of 400 Watts to 1000 Watts. The amplifier 246 is mounted to the i/o panel 212 such that heat dissipated from the amplifier 246 can be transferred through the i/o panel 212 via conduction. The heat can then be transferred from the outer surface of the i/o panel 212 to the surrounding environment via natural convection. To help facilitate the conductive heat transfer, the i/o panel made be formed of a material with high thermal conductivity, e.g., materials with a thermal conductivity greater than 100 W/m-K, such as metal, e.g., aluminum or steel. The bass reflex ports 204 may be configured to facilitate a convective air flow across the amplifier 246 within the acoustic cavity 208 for additional cooling of the amplifier 246.

The amplifier 246 is configured to power the electro-acoustic transducer 202 in the subwoofer 102 as well the line array assembly 104. In that regard, the housing 200 includes a receptacle 248 (FIG. 2A) for receiving a bottom end of the line array assembly 104. An electrical connector 250 is disposed within the receptacle 248. The electrical connector 250 is configured to engage a mating connector 500 (FIGS. 5A & 5B) on the line array assembly 104 for delivering power from the amplifier 246 to the line array assembly 104. In some implementations, the amplifier 246 provides about 250 Watts to about 1000 Watts, e.g., 300 Watts to 1000 Watts, to the subwoofer 102 and about 50 Watts to about 300 Watts, e.g., 60 Watts to 250 Watts, to the line array assembly 104.

The housing 200 has a height (h) (FIG. 2C) of about 550 mm to about 695 mm, e.g., 552.8 mm to 693.8 mm; a width (w) (FIG. 2C) of about 310 mm to about 320 mm, e.g., 315.9 mm to 316.8 mm; and a depth (d) (FIG. 3) of about 450 mm to about 550 mm, e.g., 454.8 mm to 545.9 mm. The subwoofer 102 has a total exterior volume of about 80 Liters to about 120 Liters, e.g., 79.65 Liters to 119.65 Liters; and the acoustic cavity 208 has an acoustic volume of about 30 Liters to about 60 Liters, e.g., 39.4 Liters to 53.4 Liters.

Figure 4:
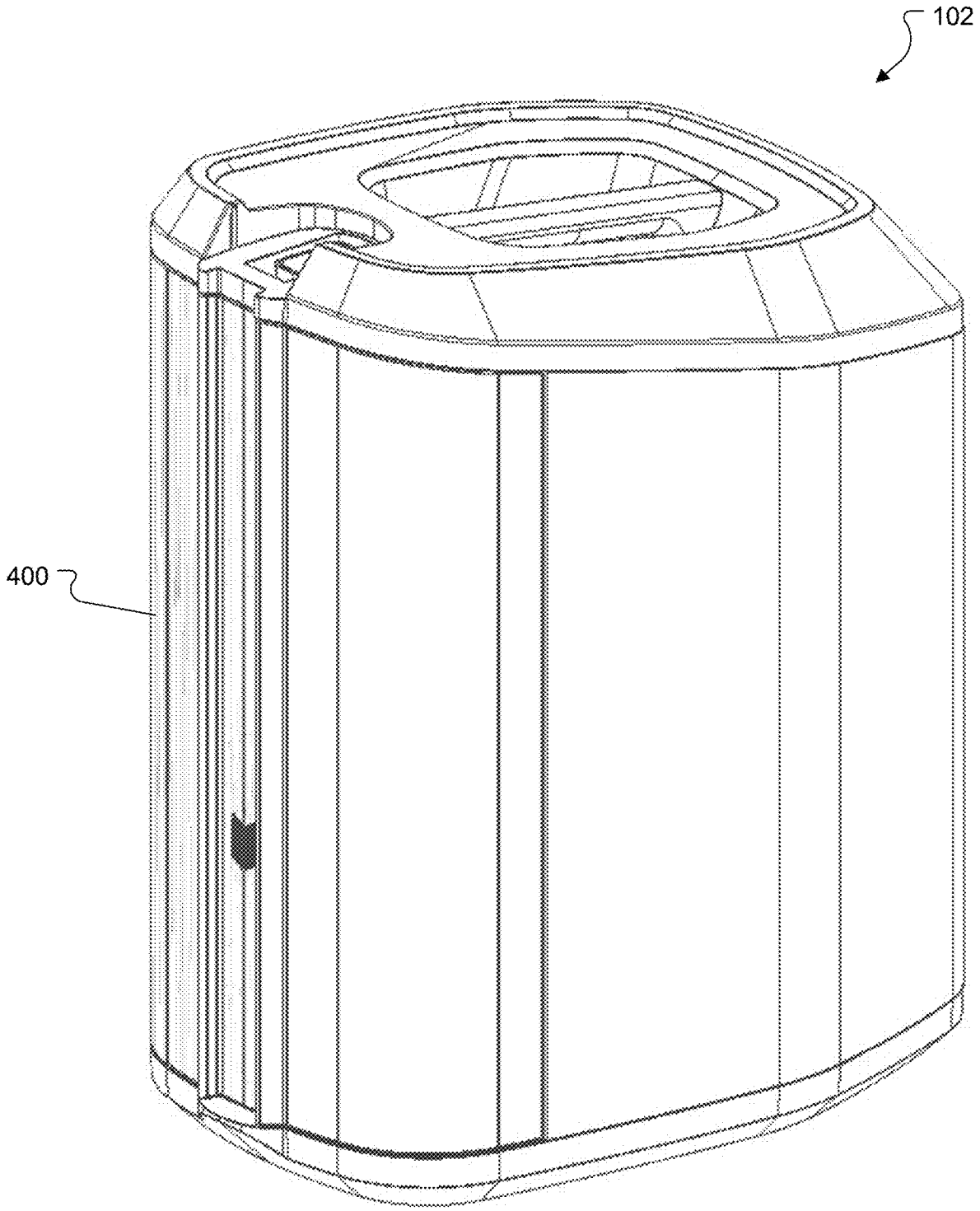
FIG. 4 is a perspective view of the subwoofer of FIG. 2A as shown, with a grille, from the front, top, and right side.

As shown in FIG. 4, an acoustically transparent grille 400 (a/k/a "subwoofer grille") covers the electro-acoustic transducer 202 along the front surface of the subwoofer 102. The grille 400 may be formed of a rigid material, such as metal, and may include a plurality of apertures to provide the acoustic transparency. In some implementations, the grille 400 may be formed, e.g., embossed, with a feature or image that corresponds to the oblong shape of the diaphragm 218.

Figure 5A:
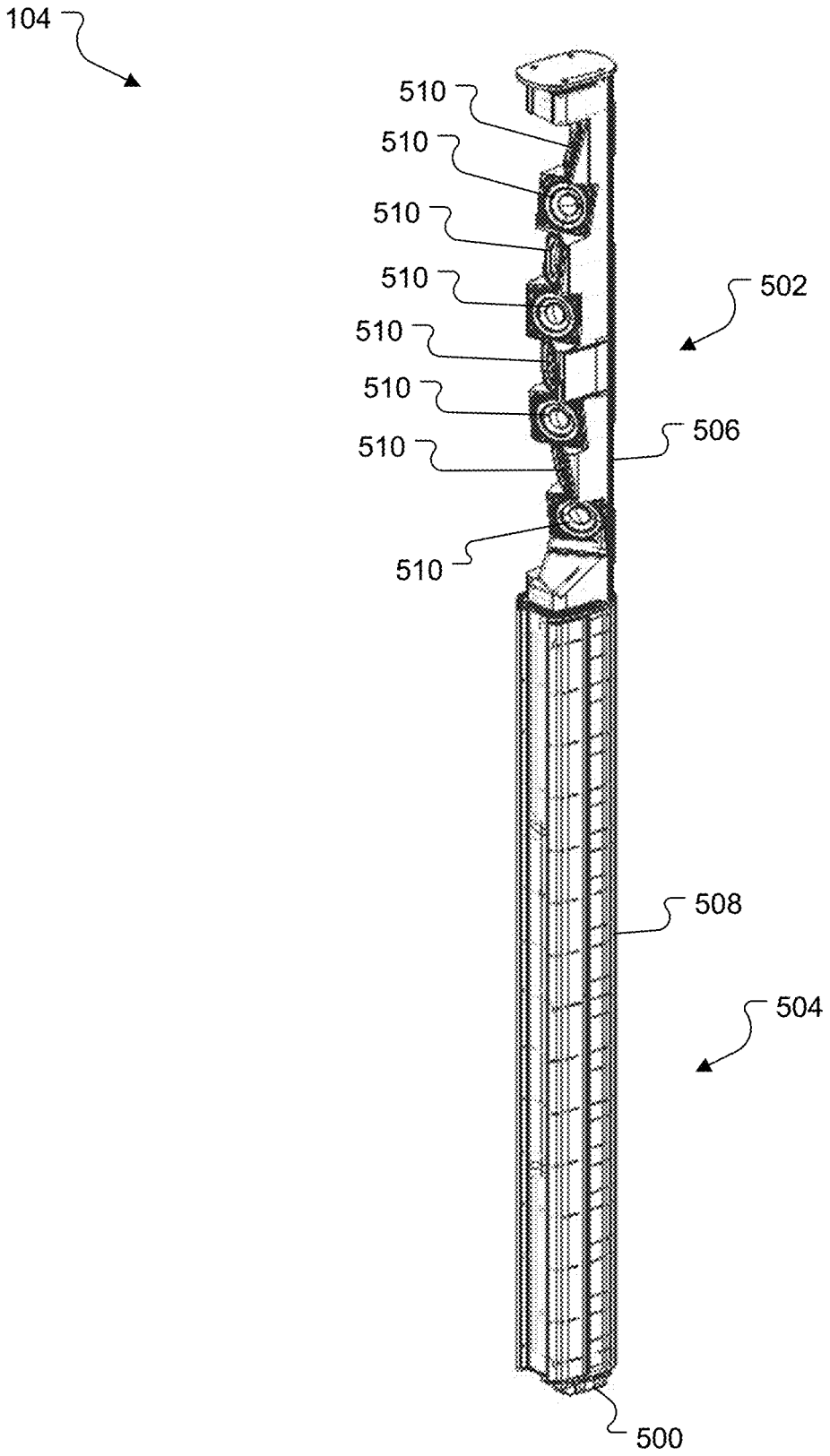
FIG. 5A is a perspective view of a line array assembly from the loudspeaker system of FIG. 1A as shown, without grilles, from the front, top, and right side.
Figure 5B:
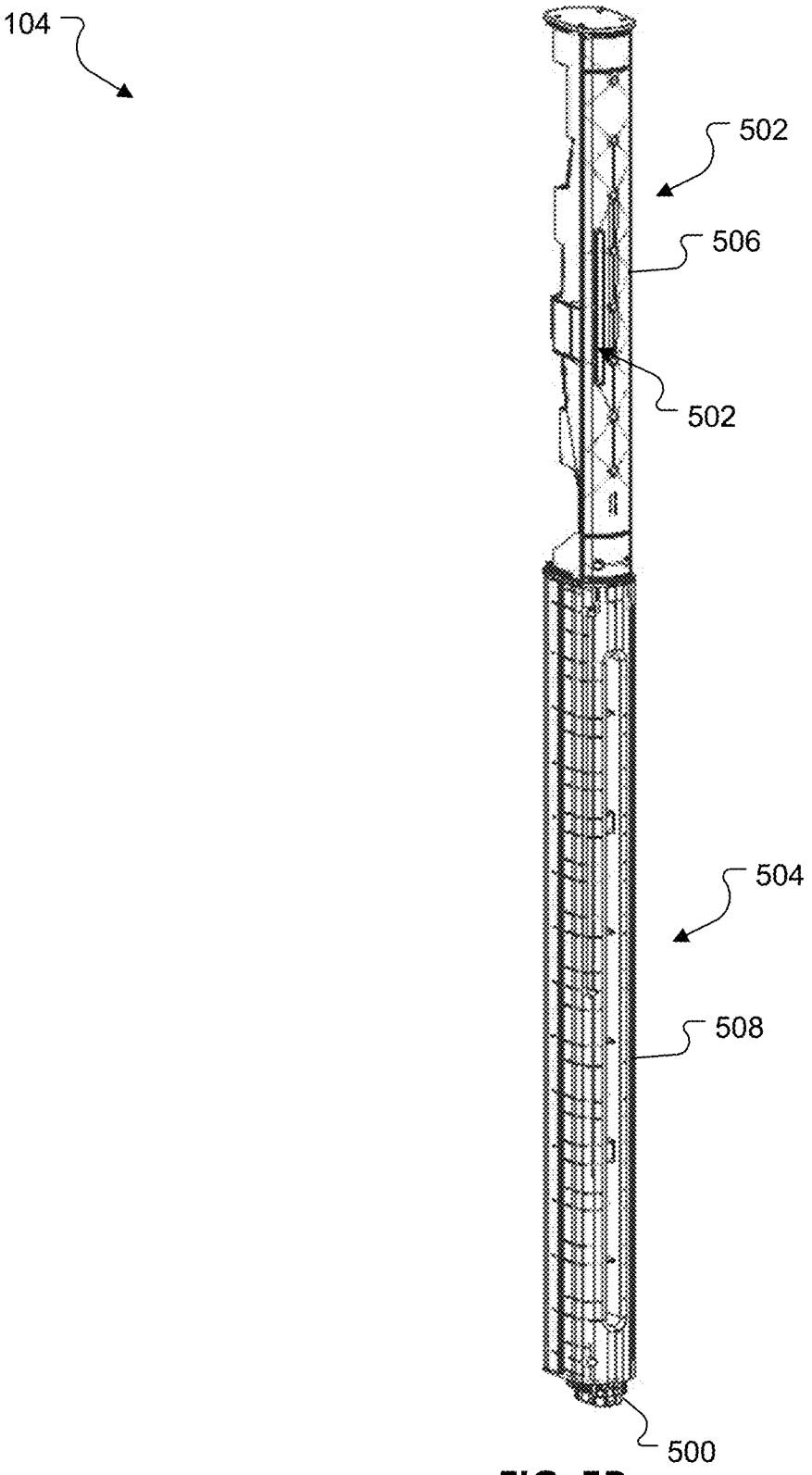
FIG. 5B is a perspective view of the line array assembly of FIG. 5A as shown from the rear, top, and right side.
Figure 6:
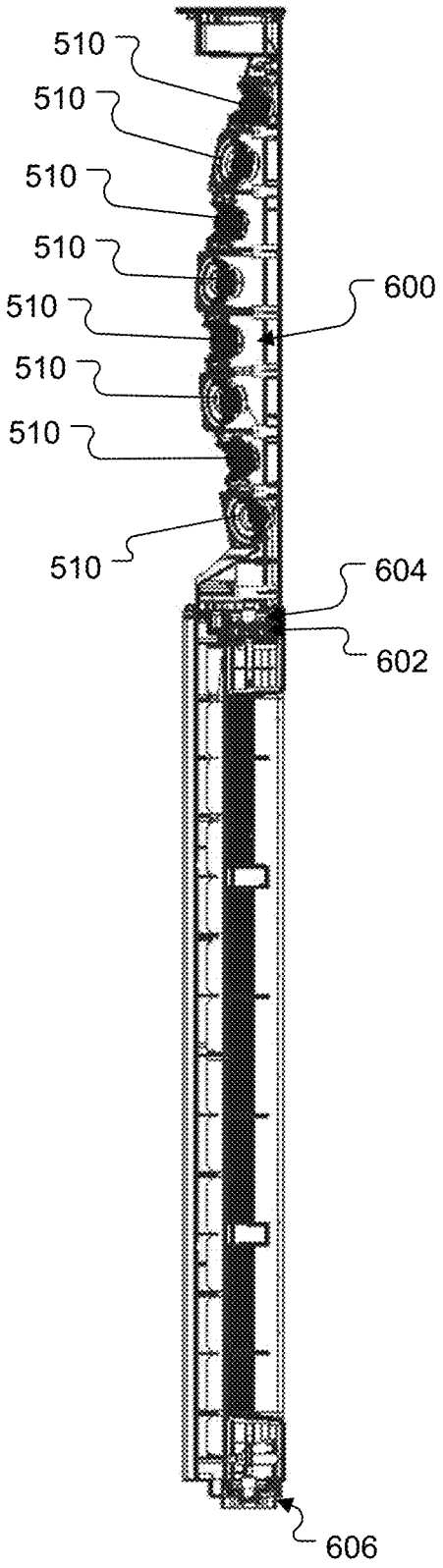
FIG. 6 is a cross-sectional side view of the line array assembly of FIG. 5A.

Referring to FIGS. 5A-6, the line array assembly 104 includes a line array 502 and an extension member 504 for supporting the line array 502. The line array 502 include a first housing 506 (a/k/a "line array housing") and the extension member 504 includes a second housing 508 (a/k/a "extension member housing"). The first and second housings 506, 508 may be formed, e.g., molded, from ABS. The first housing 506 defines an acoustic cavity 600 (FIG. 6) and supports a plurality of electro-acoustic transducers 510 (a/k/a "mid/high frequency transducers") (8 shown). The plurality of electro-acoustic transducers 510 are mid/high frequency transducers having an operating frequency range of about 200 Hz to about 18 kHz.

The electro-acoustic transducers 510 are mounted to the first housing 506 such that respective first radiating surfaces of the electro-acoustic transducers 510 radiate acoustic energy outwardly from a first surface of the first housing 506 and respective second radiating surfaces of the electro-acoustic transducers 510 radiate acoustic energy in the acoustic cavity 600. An acoustic port 512 (FIG. 5B) disposed along the rear surface of the first housing 506 acoustically couples the acoustic cavity 600 to the region surrounding the line array 502. The addition of the port to the enclosure which is tuned within the operating range may be used to lower the useful frequency range of the transducers 510.

A first acoustically transparent grille 106 (FIG. 1A) covers the plurality of electro-acoustic transducers 510 along the front surface of the first housing 506. A second acoustically transparent grille 108 (FIG. 1B) covers the acoustic port 502 along the rear surface of the first housing 506.

The second housing 508 is configured to be releasably coupled to the first housing 506. With reference to FIG. 6, the second housing 508 carries a first electrical connector 602 along its top end. The first housing 506 carries a second, mating electrical connector 604 along its bottom end. The second electrical connector 604 is electrically connected to respective electro-magnetic motors of the electro-acoustic transducers 510 carried by the first housing 506. The first and second electrical connectors 602, 604 provide a mechanical coupling between the two housings and enable electrical energy to be delivered to the electro-acoustic transducers 510 carried in the first housing 506.

A third electrical connector 606 (FIG. 6) is arranged at a bottom end of the second housing 508 for enabling an electrical connection between the line array assembly 104 and the subwoofer 102 via the electrical connector 250 (FIG. 2A) in the receptacle 248 of the subwoofer 102. The third electrical connector 606 is electrically connected to the first electrical connector 602 for passing an electrical signal to the first housing 506 (i.e., via the second electrical connector 604).

Figure 7A:
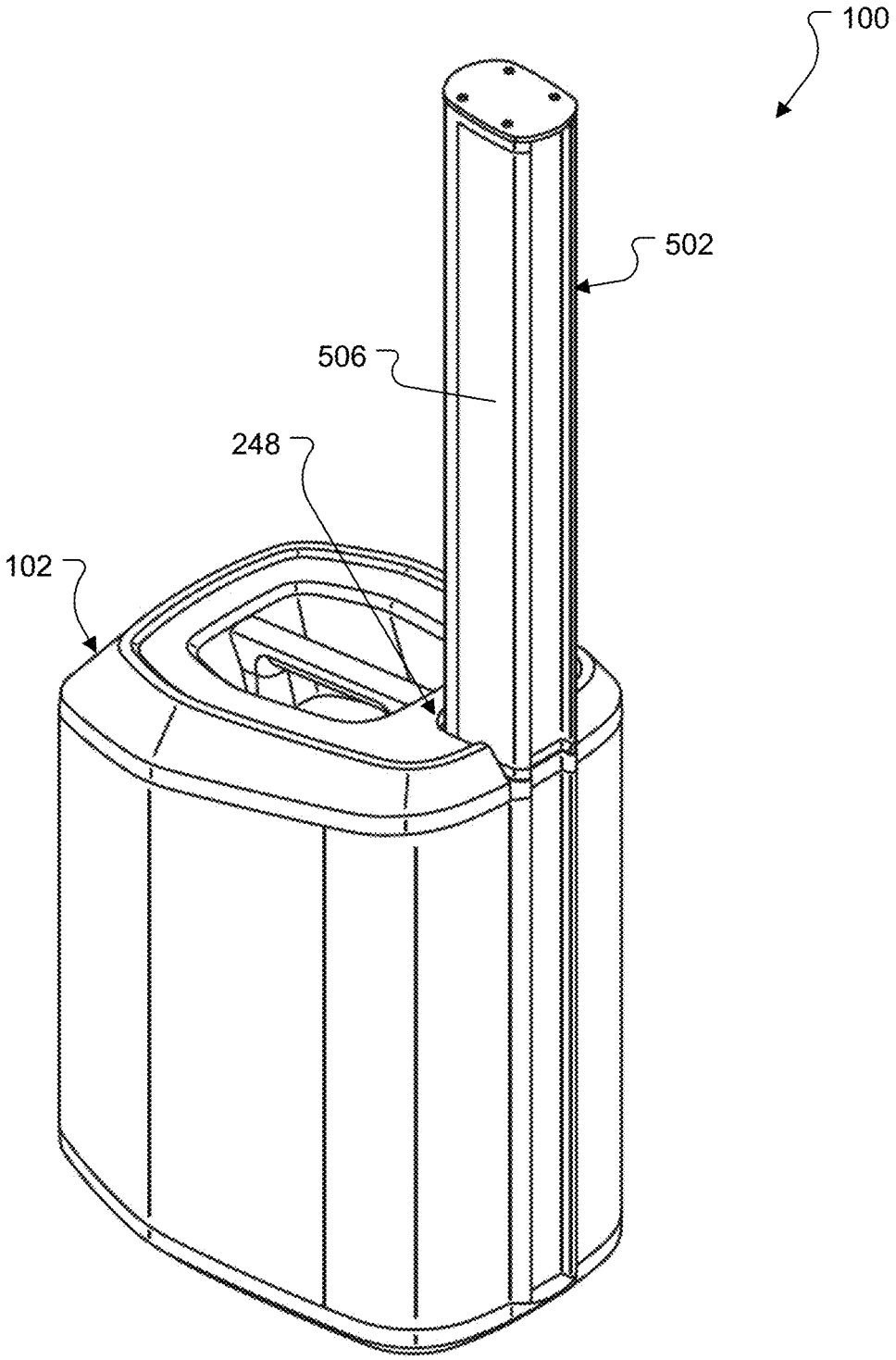
FIG. 7A is perspective view of the loudspeaker system of FIG. 1A as shown, without an extension member, from the front, top, and left side.
Figure 7B:
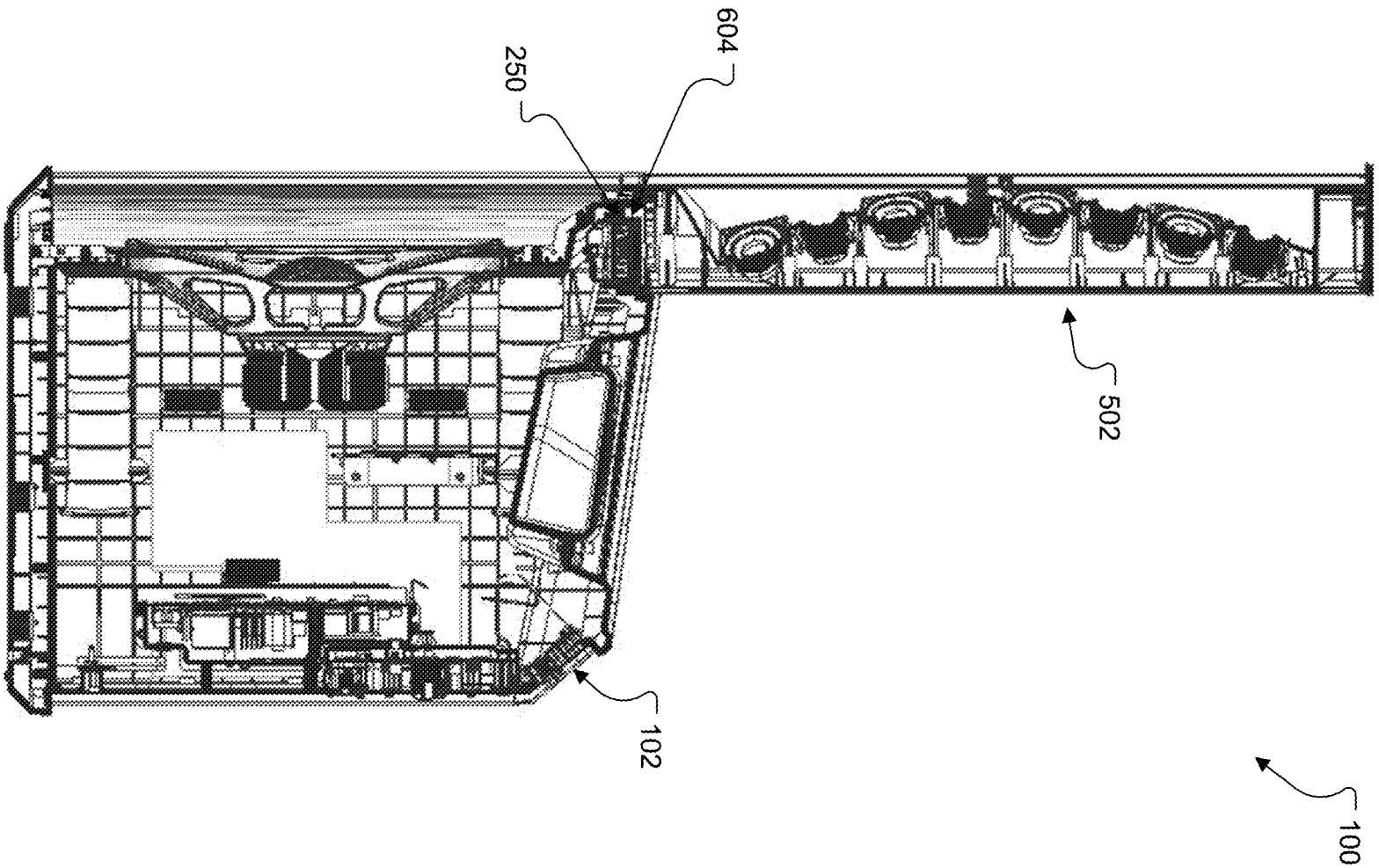
FIG. 7B is a cross-sectional side view of the loudspeaker system of FIG. 7A.

The second and third electrical connectors 604, 606 may be identical and may allow the line array 502 to be coupled to the subwoofer 102 with or without the extension member 504. For example, with reference to FIGS. 7A and 7B, the bottom end of the first housing 506 may be received directly within the receptacle 248 of the subwoofer 102 with an electrical connection being established via the second electrical connector 604 (FIG. 7B) and the electrical connector 250 in the receptacle 248 of the subwoofer 102.

OTHER IMPLEMENTATIONS

Figure 8A:
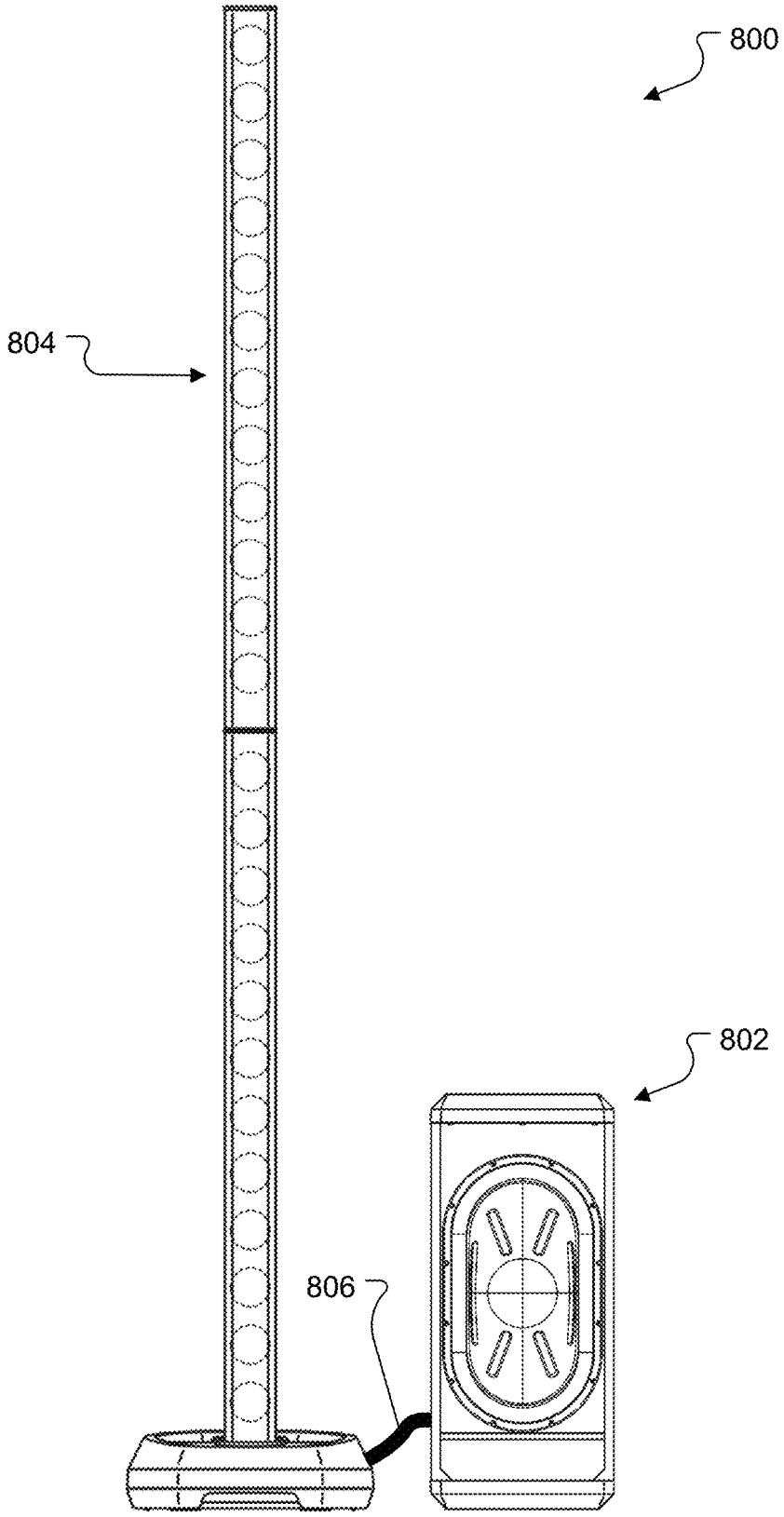
FIG. 8A is a front view of an alternative loudspeaker system with stand-alone subwoofer and line array.
Figure 8B:
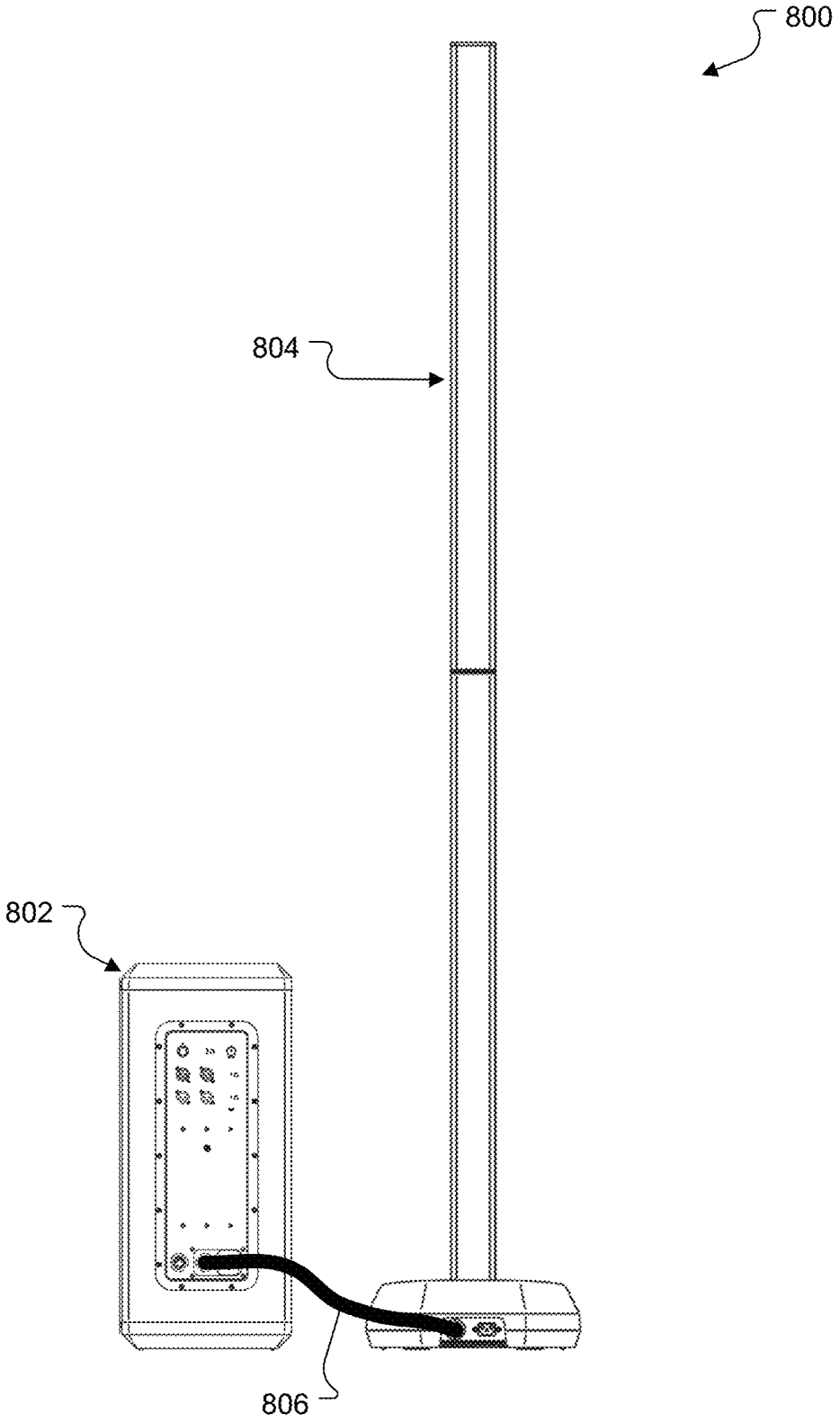
FIG. 8B is a rear view of the loudspeaker system of FIG. 8A.

While a loudspeaker system has been descried in which a line array assembly is supported by a subwoofer, in other implementations, a loudspeaker system may include a subwoofer that operates with a stand-alone line array loudspeaker. For example, FIGS. 8A and 8B illustrate an example of a loudspeaker system 800 with a stand-alone subwoofer 802 and line array loudspeaker 804 that are electrically coupled to each other via a cable connection 806. The subwoofer 802 may include one or more of the features of the subwoofer 102 described above, e.g. with respect to FIGS. 1-4, including, for example, a transducer with an oblong shape that is arranged such that its major axis is substantially vertical, relative to ground, during normal use (i.e., with the subwoofer 802 resting on its bottom wall), and a handle disposed along a top wall of the subwoofer 802 and arranged such that the major axis of the oblong transducer is arranged vertically when the subwoofer 802 is lifted and carried by the handle so that the center of mass of the subwoofer 802 rests closer to the user's body (as compared to a design with a circular diaphragm with an equivalent surface area).

Additional details regarding the stand-alone subwoofer 802 may be found in U.S. patent application Ser. No. 16/790,356, filed Feb. 13, 2020, the complete disclosure of which is incorporated herein by reference. Additional details regarding the stand-alone line array loudspeaker 804 may be found in U.S. patent application Ser. No. 16/669,682, filed Oct. 31, 2019, the complete disclosure of which is incorporated herein by reference. Additional details regarding the cable connection 806 between the subwoofer 802 and the line array loudspeaker 804 may be found in U.S. patent application Ser. No. 16/456,348, filed Jun. 28, 2019, now U.S. Pat. No. 10,652,664, the complete disclosure of which is incorporated herein by reference.

While several implementations have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the implementations described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize or be able to ascertain using no more than routine experimentation, many equivalents to the specific implementations described herein. It is, therefore, to be understood that the foregoing implementations are presented by way of example only and that, within the scope of the appended claims and equivalents thereto, implementations may be practiced otherwise than as specifically described and claimed. Implementations of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

A number of implementations have been described. Nevertheless, it will be understood that additional modifications may be made without departing from the scope of the inventive concepts described herein, and, accordingly, other implementations are within the scope of the following claims.

What is claimed is:

1. A loudspeaker system comprising:

a subwoofer comprising:

a housing comprising a plurality of walls which together define an acoustic cavity, the plurality of walls comprising a front wall, a rear wall opposite the front wall, a top wall, a bottom wall opposite the top wall, and a plurality of sidewalls that extend between the top wall and the bottom wall and between the front and rear walls;

a first electro-acoustic transducer mounted to the front wall of the housing;

wherein the first electro-acoustic transducer comprises a diaphragm having a major axis and a minor axis, and wherein the major axis is longer than the minor axis, the major axis having a first end proximate the bottom wall and an opposite, second end proximate the top wall, such that the major axis is arranged substantially vertical, relative to ground when the subwoofer is rested on its bottom wall, and wherein the top wall has a handle such that the loudspeaker can be carried with the major axis arranged vertical to ground.

2. The loudspeaker system of claim 1, wherein the sidewalls are substantially parallel with the major axis of the first electro-acoustic transducer.

3. The loudspeaker system of claim 1, further comprising an amplifier disposed within the acoustic cavity, and one or more bass reflex ports that extend through one or more of the plurality of walls, wherein the one or more bass reflex ports are arranged to facilitate a cooling air flow across the amplifier.

4. The loudspeaker system of claim 1, wherein the rear wall comprises an i/o panel, wherein the subwoofer comprises an amplifier disposed within the acoustic cavity, and wherein the amplifier is mounted to the i/o panel such that heat dissipated from the amplifier can be transferred through the i/o panel via conduction.

5. The loudspeaker system of 4, wherein the amplifier has a power output of 400 Watts to 1000 Watts.

6. The loudspeaker system of claim 4, wherein the subwoofer comprises a mixing console disposed within the acoustic cavity and mounted to the i/o panel.

7. The loudspeaker system of claim 1, wherein the major axis is about 1.30 times to about 1.50 times longer than the minor axis.

8. The loudspeaker system of claim 7, wherein the major axis is 1.38 times to 1.42 times longer than the minor axis.

9. The loudspeaker system of claim 1, wherein the subwoofer provides a Sound Pressure Level (SPL) output of about 110 dB to about 130 dB SPL with 1000 Watts or less.

10. The loudspeaker system of claim 9, wherein the subwoofer has a total package volume of 120 Liters or less.

11. The loudspeaker system of claim 10, wherein the subwoofer has a total package volume of about 80 Liters to about 120 Liters.

12. The loudspeaker system of claim 9, wherein the acoustic cavity has an acoustic volume of 60 Liters or less.

13. The loudspeaker system of claim 12, wherein the acoustic cavity has an acoustic volume of about 30 Liters to about 60 Liters.

14. The loudspeaker system of claim 1, further comprising a line array assembly, the line array assembly comprising a plurality of second electro-acoustic transducers, wherein the subwoofer comprises a receptacle for receiving the line array assembly, wherein the receptacle includes a first electrical connector and wherein the line array assembly includes a second electrical connector that is configured to mate with the first electrical connector for powering the line array assembly via the subwoofer.

15. The loudspeaker system of claim 14, wherein the second electro-acoustic transducers are mid/high frequency transducers having an operating frequency range of about 200 Hz to about 18 kHz.

16. The loudspeaker system of claim 1, wherein the diaphragm is in the shape of an ellipse, an oval, or a racetrack.

17. The loudspeaker system of claim 1, wherein the first electro-acoustic transducer is a low frequency transducer having an operating frequency range of about 20 Hz to about 300 Hz.

18. The loudspeaker system of claim 1, wherein the first electro-acoustic transducer has a suspension compliance of about 0.06 mm/N to about 0.12 mm/N; a maximum linear excursion of about 6.00 mm to about 9.50 mm; an effective cone diameter of about 22.00 cm to about 32.00 cm; an effective piston area of about 410.00 cm^2 to about 762.00 cm^2; and a maximum SPL of about 110 dB to about 130 dB.

19. The loudspeaker system of claim 1, wherein the diaphragm includes integral ribs for increased stiffness.

20. The loudspeaker system of claim 1, wherein the housing has a height-to-width ratio of about 1.7 to about 2.2.

* * * * *